United States Patent [19]

St-Pierre

[11] Patent Number: 4,586,346

[45] Date of Patent: May 6, 1986

[54] GRAVITY COOLING COIL DEVICE

[76] Inventor: Guy St-Pierre, 1057 Monteée, Ste. Julie, Quebec, Canada, J0L 2C0

[21] Appl. No.: 717,654

[22] Filed: Mar. 29, 1985

[51] Int. Cl.[4] ..... F25D 23/12

[52] U.S. Cl. ..... 62/259.1; 62/285; 62/524; 62/DIG. 16

[58] Field of Search ..... 62/DIG. 16, 259.1, 263, 62/275, 285, 440, 458, 524, 525, 526; 98/31; 165/48, 49

[56] References Cited

U.S. PATENT DOCUMENTS

| | | | |
|---|---|---|---|
| 1,868,907 | 7/1932 | King | 62/524 |
| 2,169,900 | 8/1939 | Philipp | 62/285 X |
| 2,370,267 | 2/1945 | Starr | 62/524 X |
| 3,367,132 | 2/1968 | Elliott | 62/285 |
| 3,923,098 | 12/1975 | Ares | 62/285 X |

*Primary Examiner*—Lloyd L. King

*Attorney, Agent, or Firm*—Burns, Doane, Swecker & Mathis

[57] ABSTRACT

A gravity cooling coil device comprising at least two columns of fin coils positioned side by side and defining between them a substantially unobstructed vertical air passage. Condensate troughs are secured under a respective one of the at least two columns in non-obstruction to the air passage. A collecting trough is secured at the end of the condensate receiving troughs to collect the condensate for disposition thereof. The gravity cooling coil device is provided with suitable attachment brackets for securing it in spaced relationship adjacent a ceiling of an enclosure to be cooled. The device may be constructed with columns of different size whereby to fit into a predetermined area adjacent the ceiling depending on the space available.

10 Claims, 6 Drawing Figures

GRAVITY COOLING COIL DEVICE

BACKGROUND OF INVENTION (a) Field of the Invention

The present invention relates to an improved gravity cooling coil device which comprises at least two columns of fin coils positioned side by side and defining between them a substantially unobstructed vertical air passage thereby preventing freeze-up of the cooling coils and pemitting closer spacing thereof, permitting a substantial improvement in the BTU per square inch area of cooling coil.

(b) Description of Prior Art

Gravity cooling coils are known. However, such coils usually comprise a cooling block formed of a serpentine arrangement of fin coils with the fins and the coils being spaced such as to form a substantially solid rectangular evaporator. The evaporator is supported above a large condensate collecting pan which permits ventilation therethrough whereby the cold air can pass between the various collecting channels of the pan to cool the space thereunder. This makes for a very bulky structure which is difficult to install and which occupies much space as the evaporator must be positioned a certain distance from the ceiling of a room whereby to permit proper air ventilation around the evaporator whereby environmental warm air will cool and fall by gravity. The pan is also spaced from the evaporator and is an obstruction to the convection air flow, thus reducing the efficiency of the evaporator, and further causes the evaporator to freeze up. Another problem is that on the top side of the pan there is provided a very cold mass whilst on the bottom side of the pan the air is substantially warmer. Because of this, the condensate collection pan must be constructed with double-channels whereby the condensate does not freeze up in the pan.

However, such bulky gravity coil devices have an advantage over the forced air cooling system in that they do not use a fan and motor to drive the air through the evaporator. The disadvantages of using a motor are many such as it provides a still bulkier construction, the operation of the device is noisy, it consumes energy, it requires more maintenance, it is drafty, and the effect of the blower causes dehydration of meats and plants which may be stored in the cold room. However, it is often not possible to install gravity coil devices for the reason that there is insufficient space adjacent a ceiling of a cold room enclosure to install the device. Most cold rooms prefabricated today have very low ceilings averaging about 7 feet 6 inches. Therefore, there is insufficient space to install such devices and it is necessary to revert to other types of cooling systems.

SUMMARY OF INVENTION

It is a feature of the present invention to provide a gravity cooling coil device which substantially overcomes all of the above-mentioned disadvantages of the prior art.

It is a further feature of the present invention to provide a gravity cooling coil device which occupies about 25 percent of the space of conventional gravity coil devices as above-described and which is flexible in construction whereby to adapt to restricted areas, while delivering the same BTUs as the prior art devices above-mentioned.

Another feature of the present invention is to provide a gravity cooling coil device which is easy and quick to install, easy to fabricate, easy to transport with smaller risk of damage, requires very little maintenance, and which has a long life.

According to the above features, from a broad aspect, the present invention provides a gravity cooling coil device which comprises at least two columns of coils positioned side by side and defining between them a substantially unobstructed vertical air passage. Condensate receiving means is secured under a respective one of the columns in non-obstruction to the air passage. Means is provided to collect condensate from the receiving means. Means is also provided to secure the device in spaced relationship adjacent the ceiling of a space to be cooled.

BRIEF DESCRIPTION OF DRAWINGS

A preferred embodiment of the present invention will now be described with reference to the drawings in which.

DESCRIPTION OF PREFERRED EMBODIMENTS

Figure 1:
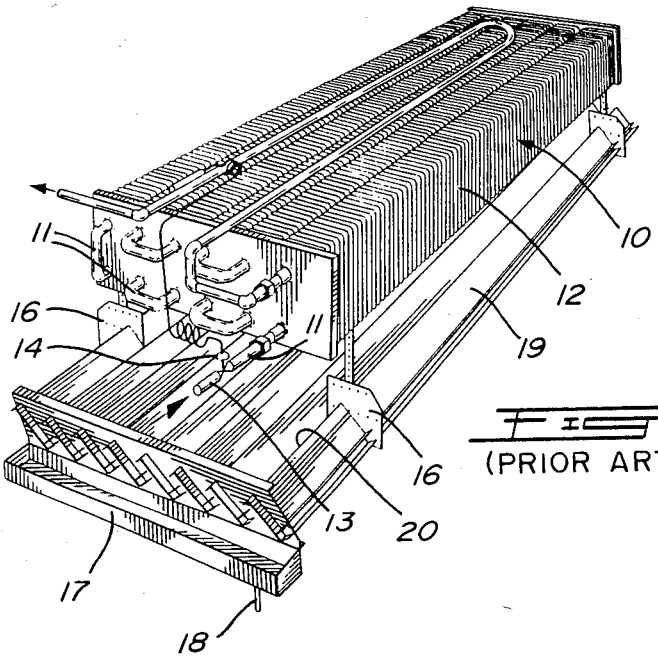
FIG. 1 (PRIOR ART)
FIG. 1 is a perspective view of a gravity cooling coil device of the prior art.

Referring now to the drawings and more particularly to FIG. 1, there is shown a gravity cooling coil device of the prior art. The prior art device comprises an evaporator 10 formed by a serpentine arrangement of a cooling coil 11 having a plurality of heat exchange fins 12 secured about the coil. Liquid freon gas is fed at the inlet 13 of the coil 11 and is expanded by an expansion valve 14 whereby the gas within the serpentine array of the tube will absorb heat thereby constituting a refrigerant coil to cool surrounding air. The cool air will of course flow down by gravity. However, the evaporator will generate condensate and in order to collect this condensate, there is provided a condensate collection pan 15 disposed below the evaporator 10. As herein shown, the evaporator is supported on brackets 16 whereby the pan is slightly angulated towards the end collection through 17 whereby condensate will flow into the trough 17 and be removed therefrom through a conduit 18.

The collection pan consists of a plurality of angulated, spaced-apart, double-wall channels 19 whereby to prevent the condensate from freezing within the pan and obstructing the flow of condensate. It can be appreciated that on the side of the pan facing the evaporator the air is very cold whereas on the bottom side of the pan the air is substantially warmer. Therefore, by providing a double-wall pan the condensate is protected from the very cold air. Convection spaces 20 are defined between each of the double-wall channels 19 whereby cold air can flow down. However, the air is still obstructed substantially by this pan. Because of this obstruction evaporator will often freeze up forming a solid block of ice due to bad ventilation caused by the fact that one side of the evaporator is closely spaced to the ceiling while the bottom side is closely spaced to a condensate collection pan.

Referring now to FIGS. 2 to 5 there is shown the basic construction of the gravity cooling coil device of the present invention. This device comprises at least two columns, herein three columns 22 of a serpentine fin coil, with the columns positioned side by side and defining between them a substantially unobstructed vertical air passage 23. Each of the columns are elongated rectangular columns constituted by rectangular heat exchange fins 24 with the long axis of the cross-section of the columns being oriented vertically. A plurality of cooling tubes 22' (see FIG. 4) are disposed longitudinally and substantially parallel to one another within each of the columns. These tubes are sections of one or more cooling coils in which expanded freon gas is circulated whereby to refrigerate the columns.

As shown in these drawings, each of the columns 22 has a condensate pan or channel 25 removably secured thereunder whereby condensate from the fins of each column will drip in its own collection channel. Also, these channels do not obstruct the air passages 23 between the columns. Further, the channels 25 are sloped rearwardly towards a collection trough 26 having a conduit 27 in the bottom wall thereof to remove condensate from the trough. Thus, the evaporator can be maintained substantially horizontal which is preferred for a more efficient functioning of the evaporator.

Figure 2:
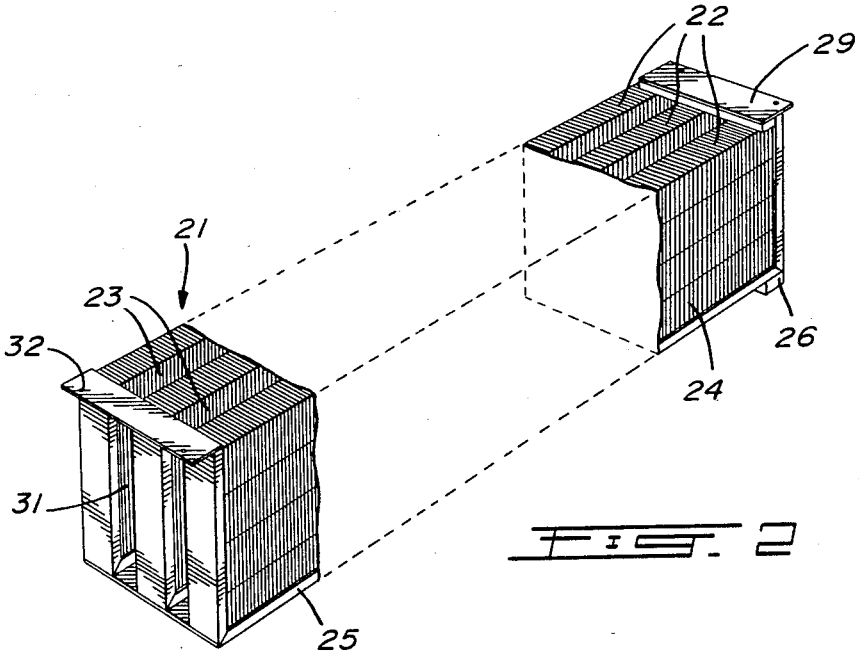
FIG. 2 is a perspective view of the cooling coil device showing three columns of fin coils positioned side by side and defining between them an unobstructed vertical air passage.

Because these columns are fairly narrow and have unobstructed air passages 23 therebetween, there is improved ventilation about the columns thereby permitting the coils to be spaced closer together than in the prior art device and thus providing for a more efficient evaporator with improved air circulation due to the fact that the condensate collecting pan 15 of the prior art has been eliminated. Because the coils are positioned closer to each other the surface area of the device is substantially smaller than the prior art device of FIG. 1, while delivering the same BTU. The size of the device of the present invention is about one-fourth the size of the cooling coil device shown in FIG. 1. For example, the device shown in FIG. 1 has an overall dimension, including the pan and the air space between the ceiling and the evaporator, of about $33\times66\times15$ inches whereas the coolilng coil device as shown in FIG. 2 has an overall dimension including air space of $12\times13\times51$ inches.

The cooling coil device of the present invention is provided with bracket members 28 and 29 at each end thereof whereby to secure the device to a ceiling surface. One of the bracket members, usually the rear bracket 29, is constituted by a pre-formed plate having a supporting channel 30 in a top end thereof and extending a predetermined distance X above the plurality of columns 22. The outside wall of the plate 29 is also provided with vent openings 31 to permit the passage of air between the columns. The bottom end of the bracket 29 forms the collection trough 26.

The other bracket member 28 is also provided with a support channel 32 in a top end thereof and extends the same predetermined distance above the columns 22. In order to secure the cooling coil device adjacent a ceiling, there is provided two support bars 33 which are slidingly received and extend through two respective ones of the support channels 30 and 32. These bars have fasteners and spaces (not shown) adjacent their opposed ends and in order to install the device to the ceiling, it is firstly required to fasten one end of each bar 33 to the ceiling while leaving the other end loose. Of course, the bars are spaced a distance apart corresponding to the distance of the support channels 30 and 32. The free end of the bars are then slid into their respective channels by moving the cooling coil device adjacent the ceiling and while maintaining the device in position, the other end of the bar is fastened to the ceiling with a screw and spacing washer (not shown). Thus, the entire device may be removed by simply removing two screws and washers and sliding it off the bars 33.

Figure 3:
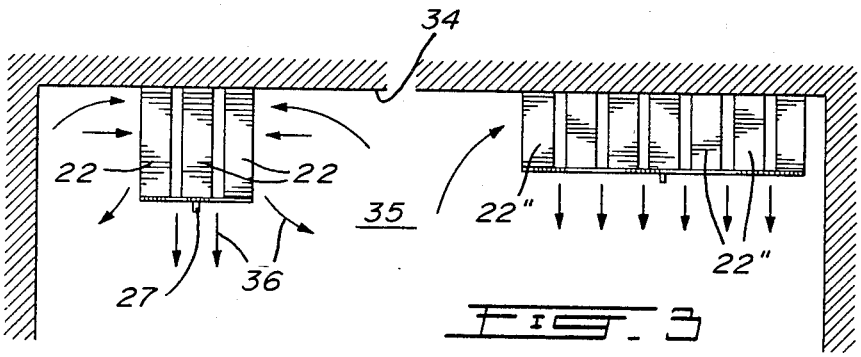
FIG. 3 is a schematic illustration of two examples of a gravity cooling coil device of the present invention as secured adjacent a ceiling of a refrigerated enclosure.

An example of the dimensions of a cooling coil device of the present invention is herein given whereby to establish, without being limited thereto, the ratios between the air space and the cross-section of the columns. As shown in the embodiment of FIG. 2, the columns have a dimension of 3 inches in width while the air passage in between is 1.5 inches. The top convention air space between the ceiling and the top of the columns is approximately 1 inch. It is to be understood that the columns 22 may be of different sizes therefore resulting in more columns and air passages, if the gravity cooling device is to be adapted to a smaller space under a ceiling, such as shown at 22'' in FIG. 3. As shown in FIG. 3, warm air adjacent the ceilings 34, of a refrigerated room 35, is cooled by the refrigerated columns 22 and drops down in the direction of arrows 36 due to the fact that cold air is heavier than warm air. Seeing that this air is not forced by any fan, the air has a larger percentage of humidity and is not drafty, which draft is often hazardous to people working under such cooling coils. Such draft-free cooling coils thus provide comfortable working conditions and will preserve meat, flowers, and many other products longer than forced air refrigeration apparatus which usually dehydrates such products.

Figure 4:
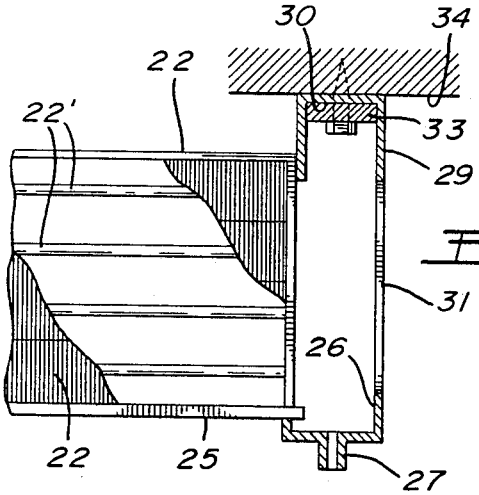
FIG. 4 is a fragmented perspective view, partly in cross-section, showing the condensate collector and the securing means for the device to attach same to a ceiling.
Figure 6:
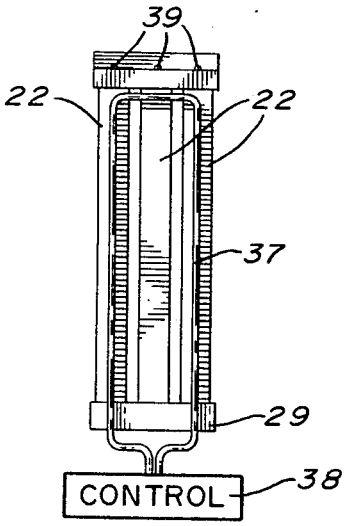
FIG. 6 is a schematic diagram of the bottom view of the gravity cooling coil device showing the position of a heater coil.
Figure 5:
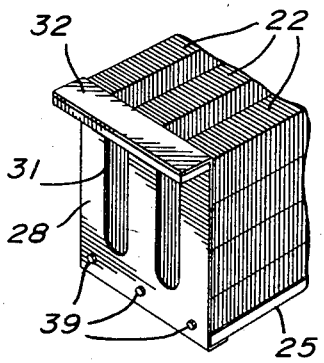
FIG. 5 is a perspective view of the opposite end of the gravity cooling coil device of the present invention.

Referring now to FIG. 6, there is shown a variant wherein a resistive heating element 37 may be supported spaced below the columns 22 whereby when the refrigeration cycle has terminated a control device 38 will switch on the resistive elements to defrost the individual columns. Also, each of the condensate collecting troughs 25 is removably secured to the support bracket by means of fasteners 39 whereby each trough can be removed and cleaned. As shown in FIG. 4, the other end of the troughs 25 is freely supported on the collection trough 26 or may be secured thereto by any well-known fastening means, such as brackets.

It can thus be seen that the present invention provides a very compact, highly efficient, easy to install and maintain gravity cooling coil device which is capable of being constructed in a variety of dimensions for installation in a limited amount of space. The device is also not encumbered with the prior art collection pans and thus is easy to package and transport, and in many instances can be installed by a single person and substantially faster than prior art cooling coil devices. Seeing that the device does not utilize a blower, it is noiseless, does not consume electrical energy, and does not require much maintenance. Also, the cooled air does not dehydrate meat products to the same extent as does blower-type refrigerating equipment.

It is within the ambit of the present invention to cover any obvious modifications of the example of the preferred embodiment described herein, provided such modifications fall within the scope of the appended claims.

I claim:

1. A gravity cooling coil device comprising at least two columns of fin coils positioned side by side in spaced-apart relationship and defining between them a substantially unobstructed vertical air passage, a pan secured immediately below a respective one of said columns in non-obstruction to said air passage, said pans having a common end thereof connected to a collection trough to collect condensate from said pans, said collection trough having a conduit connected thereto for the removal of condensate therefrom, a bracket member secured at opposed ends of said device to secure same in spaced relationship adjacent a ceiling of a space to be cooled, one of said bracket members being a pre-formed plate having a support channel in a top end thereof and extending a predetermined distance above said at least two columns, an outside wall having vent openings therein for the passage of air between said columns, and a channel bottom end constituting said collection trough.

2. A gravity cooling coil device as claimed in claim 1 wherein each of said columns are elongated rectangular columns having a rectangular cross-section defined by heat exchange fins, the longitudinal axis of said cross-section being oriented vertically, and a plurality of cooling tubes disposed longitudinally within each of said columns and spaced apart from one another, said tubes being sections of one or more cooling coils having an expanded freon gas circulating therein to refrigerate said columns.

3. A gravity cooling coil device as claimed in claim 2 wherein said tubes are sections of a single serpentine cooling coil, said tubes being disposed spaced apart in respective substantially parallel common horizontal planes passing through said columns.

4. A gravity cooling coil device as claimed in claim 1 wherein said vertical air passage has a width which is about one-half the width of said columns.

5. A gravity cooling coil device as claimed in claim 1 wherein said pans are inclined from the horizontal toward said collection trough whereby condensate collected in said pans will flow into said trough by gravity.

6. A gravity cooling coil device as claimed in claim 1 wherein the other of said bracket members is also provided with a support channel in a top end thereof extending said predetermined distance, a support bar disposable through a respective one of said support channels, said bars having fastening means at opposed ends thereof for attachment to said ceiling with the bars being slidingly received in said support channels.

7. A gravity cooling coil device as claimed in claim 1 wherein said at least two columns are supported in spaced relationship to said ceiling whereby to define a top convection air space thereabove, said top convection air space being equal to approximately the width of one of said air passages.

8. A gravity cooling coil device as claimed in claim 1 wherein a plurality of cooling tubes are disposed longitudinally within each said columns and spaced in substantially parallel relationship from one another, said tubes being sections of one or more cooling coils, each said tubes having closely spaced heat exchange fins secured transversely thereto, said fins having a width which is approximately half the dimension of its length.

9. A gravity cooling coil device as claimed in claim 8 wherein each column comprises two or more of said fin tubes positioned vertically one adjacent the other.

10. A gravity cooling coil device as claimed in claim 9 wherein each said tubes and associated fins constitute a column, there being a plurality of spaced apart columns secured in side-by-side relationship.

* * * * *